US012693054B2

(12) United States Patent
Kinoshita et al.

(10) Patent No.: US 12,693,054 B2
(45) Date of Patent: Jul. 28, 2026

(54) REFRIGERANT FLOW PATH MODULE AND HEAT SOURCE UNIT

(71) Applicant: DAIKIN INDUSTRIES, LTD., Osaka (JP)

(72) Inventors: Atsushi Kinoshita, Osaka (JP); Fumiaki Koike, Osaka (JP); Junichi Hamadate, Osaka (JP); Noriko Hoshiyama, Osaka (JP); Asahi Ono, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 19/098,105

(22) Filed: Apr. 2, 2025

(65) Prior Publication Data

US 2025/0230959 A1 Jul. 17, 2025

Related U.S. Application Data

(63) Continuation of application No. PCT/JP2023/037633, filed on Oct. 18, 2023.

(30) Foreign Application Priority Data

Nov. 30, 2022 (JP) ..... 2022-191826
Jan. 6, 2023 (JP) ..... 2023-001135

(51) Int. Cl.
*F25B 41/26* (2021.01)
*F25B 13/00* (2006.01)
*F25B 41/24* (2021.01)

(52) U.S. Cl.
CPC ..... *F25B 41/26* (2021.01); *F25B 13/00* (2013.01); *F25B 41/24* (2021.01); *F25B 2313/006* (2013.01); *F25B 2313/02741* (2013.01)

(58) Field of Classification Search
CPC ..... F25B 41/26; F25B 41/24; F25B 13/00; F25B 3313/006; F25B 2313/02741; F25B 2313/006
See application file for complete search history.

(56) References Cited

U.S. PATENT DOCUMENTS

2005/0183436 A1 8/2005 Jung et al.
2022/0003463 A1 1/2022 Takegami et al.

FOREIGN PATENT DOCUMENTS

CN 202675718 U * 1/2013
CN 211423451 U * 9/2020
(Continued)

OTHER PUBLICATIONS

Komiya, Combination Valve of Four-Way Selector Valve . . . , Nov. 16, 2001, JP2001317839A, Whole Document (Year: 2001).*
(Continued)

*Primary Examiner* — Larry L Furdge
(74) *Attorney, Agent, or Firm* — Osha Bergman Watanabe & Burton LLP

(57) ABSTRACT

A refrigerant flow path module includes: a first pipe portion having a cylindrical flow path and connected to a discharge pipe through which a refrigerant discharged from a compressor of a refrigerant circuit flows; and a second pipe portion having a cylindrical flow path and connected to a suction pipe through which a refrigerant to be sucked into the compressor flows. The first pipe portion and the second pipe portion are integrally formed. An end of the first pipe portion is connected to an end of the discharge pipe. An end of the second pipe portion is connected to an end of the suction pipe.

13 Claims, 12 Drawing Sheets

(56) References Cited

FOREIGN PATENT DOCUMENTS

| | | | | |
|---|---|---|---|---|
| CN | 113646596 | A | | 11/2021 |
| JP | H0650571 | A | * | 2/1994 |
| JP | H07012879 | U | | 3/1995 |
| JP | H08-042737 | A | | 2/1996 |
| JP | H09144661 | A | * | 6/1997 |
| JP | H09196515 | A | * | 7/1997 |
| JP | 2001-133079 | A | | 5/2001 |
| JP | 2001317839 | A | * | 11/2001 |
| JP | 2005-241236 | A | | 9/2005 |
| JP | 2006-125699 | A | | 5/2006 |
| JP | 2007-101152 | A | | 4/2007 |
| JP | 2017-058098 | A | | 3/2017 |
| JP | 2019-218977 | A | | 12/2019 |

OTHER PUBLICATIONS

Liang, Room Air Conditioner, Jan. 16, 2013, CN202675718U, Whole Document (Year: 2013).*

Wakao, Piping Unit of Heat Pump Type Air Conditioner, Jul. 31, 1997, JPH09196515A, Whole Document (Year: 1997).*

Ilketani et al., Outdoor Device of Air Conditioner, Jun. 7, 1994, JPH06159733A, Whole Document (Year: 1994).*

Qibiao Lu et al., Switching Valve and Refrigerator with High Reliability, Sep. 4, 2020, CN211423451U, Whole Document (Year: 2020).*

Hibino, Vibration Damping Device for Compressor Piping, Jun. 3, 1997, JPH09144661A, Whole Document (Year: 1997).*

Iwata et al., Tube Vibration Damper for Air Conditioner, Feb. 22, 1994, JPH0650571A, Whole Document (Year: 1994).*

International Search Report issued in corresponding International Application No. PCT/JP2023/037633, mailed Jan. 9, 2024 (3 pages).

Notice of Reasons for Refusal issued in corresponding Japanese Patent Application No. 2023-001135, mailed Jan. 9, 2024 (14 pages).

Decision to Grant a Patent issued in corresponding Japanese Patent Application No. 2023-001135, mailed Apr. 9, 2024 (5 pages).

English translation of the International Preliminary Report on Patentability issued in corresponding International Application No. PCT/JP2023/037633, dated Jun. 12, 2025 (8 pages).

* cited by examiner

REFRIGERANT FLOW PATH MODULE AND HEAT SOURCE UNIT

TECHNICAL FIELD

The present disclosure relates to a refrigerant flow path module and a heat source unit.

BACKGROUND

PATENT LITERATURE 1 discloses an outdoor unit of an air conditioner including a refrigeration cycle in which a compressor, a four-way switching valve, an outdoor heat exchanger, and a throttle mechanism are connected by pipes, and a housing that houses the refrigeration cycle. The problem of this type of outdoor unit is how to suppress transmission of vibration generated by operation of the compressor. In order to solve this problem, in the outdoor unit described in PATENT LITERATURE 1, a discharge pipe and a suction pipe connected between the compressor and the four-way switching valve, other pipes, and constituent members such as the housing are fixed by a fixture including a vibration-proof elastic material, and vibration transmitted from the compressor to each pipe is attenuated by the fixture.

PATENT LITERATURE

PATENT LITERATURE 1: Japanese Laid-Open Patent Publication No. 2006-125699

SUMMARY (1) A refrigerant flow path module of the present disclosure includes a first pipe portion to which a discharge pipe through which a refrigerant discharged from a compressor of a refrigerant circuit flows is connected, the first pipe portion having a cylindrical flow path, and a second pipe portion to which a suction pipe through which a refrigerant to be sucked into the compressor flows is connected, the second pipe portion having a cylindrical flow path, in which the first pipe portion and the second pipe portion are integrally formed.

(2) A heat source unit of the present disclosure includes the compressor and the refrigerant flow path module according to (1).

DETAILED DESCRIPTION

Hereinafter, embodiments of the present disclosure will be described in detail with reference to the accompanying drawings.

First Embodiment

Figure 1:
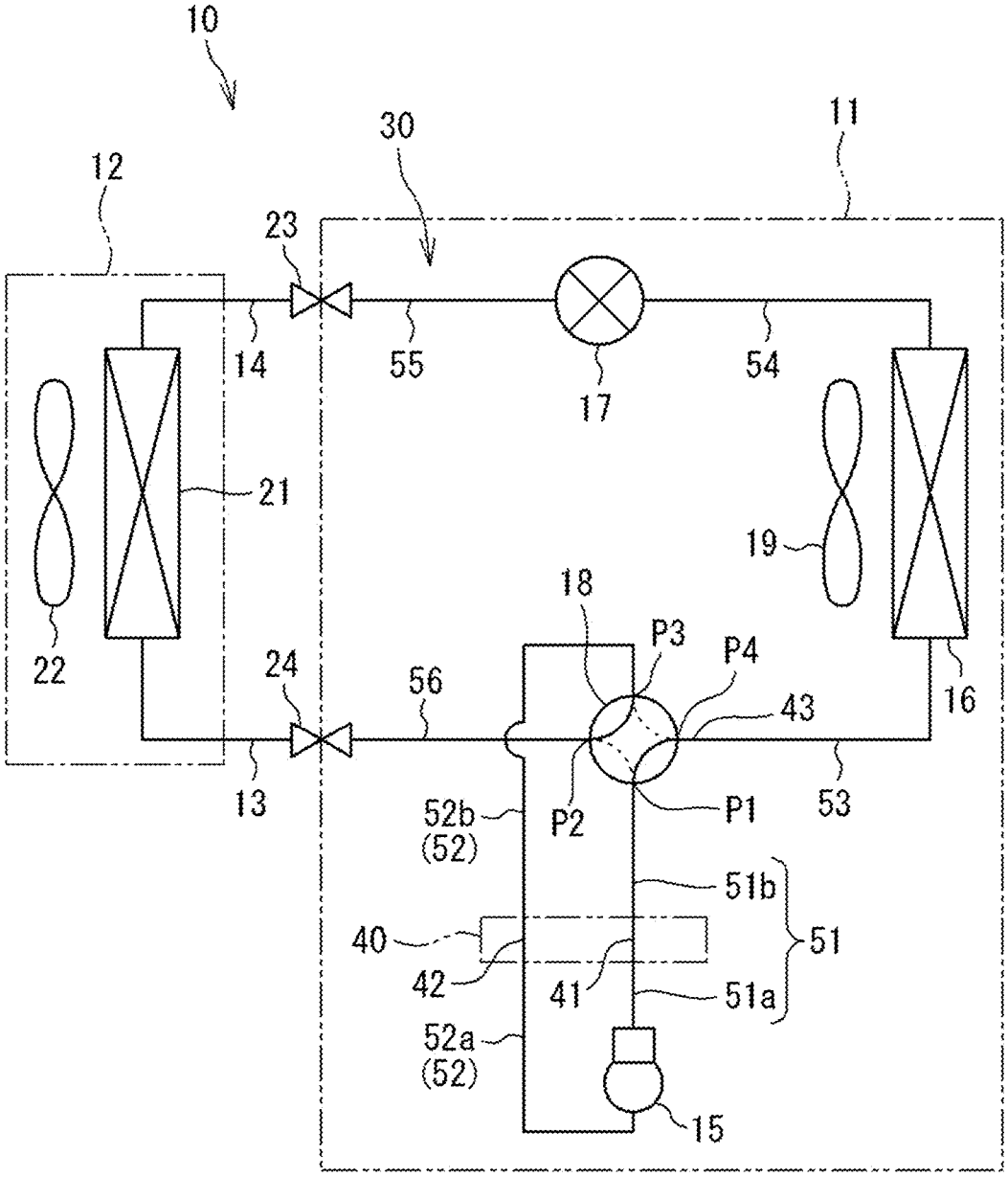
FIG. 1 is a schematic diagram of a refrigerant circuit of a refrigeration cycle apparatus including a heat source unit according to a first embodiment of the present disclosure.
Figure 2:
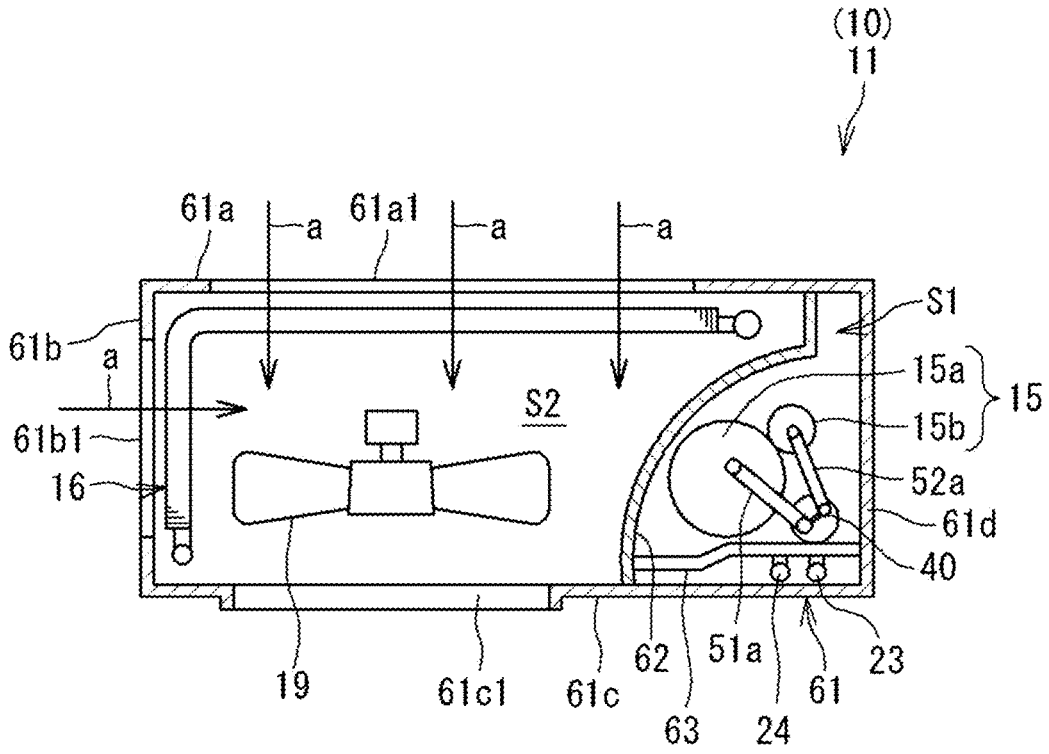
FIG. 2 is a plan view of an interior of the heat source unit.

FIG. 1 is a schematic diagram of a refrigerant circuit of a refrigeration cycle apparatus including a heat source unit according to a first embodiment of the present disclosure. FIG. 2 is a plan view of an interior of the heat source unit.

A refrigeration cycle apparatus 10 includes a refrigerant circuit 30 that executes vapor compression refrigeration cycle operation. The refrigeration cycle apparatus 10 according to one or more embodiments is an air conditioner. As shown in FIG. 1, an air conditioner 10 includes an outdoor unit (heat source unit) 11 and an indoor unit (utilization unit) 12. The outdoor unit 11 and the indoor unit 12 are connected by connection pipes 13 and 14, respectively. The outdoor unit 11, the indoor unit 12, and the connection pipes 13 and 14 form the refrigerant circuit 30. Note that the refrigeration cycle apparatus 10 is not limited to an air conditioner, and may be, for example, a refrigerator, a freezer, a water heater, a floor heating apparatus, or the like.

Configuration of Refrigerant Circuit

As shown in FIG. 1, the outdoor unit 11 is provided with a compressor 15, an outdoor heat exchanger (first heat exchanger) 16, an expansion valve 17, and a four-way switching valve (flow path switching valve) 18 constituting the refrigerant circuit 30. The outdoor unit 11 is also provided with an outdoor fan 19. The indoor unit 12 is provided with an indoor heat exchanger (second heat exchanger) 21 constituting the refrigerant circuit 30. The indoor unit 12 is also provided with an indoor fan 22.

The compressor 15 is, for example, a positive displacement compressor such as a scroll type or a rotary type, and incorporates a compressor motor. The compressor 15 compresses a low-pressure refrigerant sucked from a suction pipe 52*a*, and then discharges the compressed refrigerant from a discharge pipe 51*a*. In the outdoor unit 11, a discharge side of the compressor 15 is connected to a first port P1 of the four-way switching valve 18 via a refrigerant pipe 51. A suction side of the compressor 15 is connected to a third port P3 of the four-way switching valve 18 via a refrigerant pipe 52. As shown in FIG. 2, the compressor 15 according to one or more embodiments includes a compressor body 15*a* and an accumulator 15*b* attached to the compressor body 15*a*. The accumulator 15*b* substantially constitutes a suction portion of the compressor 15. The accumulator 15*b* is a container for separating the low-pressure refrigerant to be sucked into the compressor body 15*a* into a gas refrigerant and a liquid refrigerant.

The outdoor heat exchanger 16 includes a cross-fin type fin-and-tube heat exchanger, a microchannel heat exchanger, or the like. A gas-side end of the outdoor heat exchanger 16 is connected to a fourth port P4 of the four-way switching valve 18 via a refrigerant pipe 53. A liquid-side end of the outdoor heat exchanger 16 is connected to one end of the expansion valve 17 via a refrigerant pipe 54.

The expansion valve 17 is, for example, an electric valve whose opening degree is adjustable. The other end of the expansion valve 17 is connected to a liquid-side shutoff valve 23 via a refrigerant pipe 55.

The indoor heat exchanger 21 includes a cross-fin type fin-and-tube heat exchanger, a microchannel heat exchanger, or the like. A liquid-side end of the indoor heat exchanger 21 is connected to the liquid-side shutoff valve 23 via the liquid-side connection pipe 14. A gas-side end of the indoor heat exchanger 21 is connected to a gas-side shutoff valve 24 via the gas-side connection pipe 13. The gas-side shutoff valve 24 is connected to a second port P2 of the four-way switching valve 18 via a refrigerant pipe 56.

The four-way switching valve 18 switches a flow path between a first mode (mode indicated by a solid line in FIG. 1) in which the first port P1 and the fourth port P4 communicate with each other and the second port P2 and the third port P3 communicate with each other and a second mode (mode indicated by a dotted line in FIG. 1) in which the first port P1 and the second port P2 communicate with each other and the third port P3 and the fourth port P4 communicate with each other. In the first mode, the refrigerant discharged from the compressor 15 flows to the outdoor heat exchanger 16, and in the second mode, the refrigerant discharged from the compressor 15 flows to the indoor heat exchanger 21.

The outdoor fan 19 is disposed near the outdoor heat exchanger 16. The outdoor fan 19 is rotationally driven by a motor and blows air to the outdoor heat exchanger 16. The refrigerant flowing inside the outdoor heat exchanger 16 exchanges heat with outdoor air sent by the outdoor fan 19, and evaporates or condenses.

The indoor fan 22 is disposed near the indoor heat exchanger 21. The indoor fan 22 is rotationally driven by a motor and blows air to the indoor heat exchanger 21. The refrigerant flowing inside the indoor heat exchanger 21 exchanges heat with outdoor air sent by the indoor fan 22, and condenses or evaporates.

In the air conditioner 10, a cooling operation is performed when the four-way switching valve 18 is in the first mode, and a heating operation is performed when the four-way switching valve 18 is in the second mode. In the cooling operation, the gas refrigerant discharged from the compressor 15 flows through the four-way switching valve 18 to the outdoor heat exchanger 16 functioning as a condenser, and is condensed into a liquid refrigerant. This liquid refrigerant is decompressed by the expansion valve 17 to become a gas-liquid two-phase refrigerant, and flows into the indoor heat exchanger 21 functioning as an evaporator. The gas-liquid two-phase refrigerant exchanges heat with the air sent by the indoor fan 22 and is evaporated into a gas refrigerant. The air cooled by the heat exchange is supplied into the room. The gas refrigerant flowing out of the indoor heat exchanger 21 is sucked into the compressor 15 through the four-way switching valve 18.

In the heating operation, the gas refrigerant discharged from the compressor 15 flows through the four-way switching valve 18 to the indoor heat exchanger 21 functioning as a condenser. The gas refrigerant exchanges heat with the air sent by the indoor fan 22 and is condensed into a liquid refrigerant. The air heated by the heat exchange is supplied into the room. The liquid refrigerant flowing out of the indoor heat exchanger 21 is decompressed by the expansion valve 17 to become a gas-liquid two-phase refrigerant, and flows into the outdoor heat exchanger 16 functioning as an evaporator. The gas-liquid two-phase refrigerant is evaporated into a gas refrigerant in the outdoor heat exchanger 16. The gas refrigerant is sucked into the compressor 15 through the four-way switching valve 18.

Configuration of Outdoor Unit

As shown in FIG. 2, the outdoor unit 11 includes a casing 61. The casing 61 has a rectangular parallelepiped shape and has a quadrilateral shape in plan view. The casing 61 has an interior provided with a partition wall 62 that partitions a machine chamber S1 and a heat exchange chamber S2. The machine chamber S1 accommodates the compressor 15. In addition to the compressor 15, the machine chamber S1 also accommodates the shutoff valves 23 and 24, the four-way switching valve 18, the expansion valve 17, and the like.

The heat exchange chamber S2 of the casing 61 accommodates the outdoor heat exchanger 16, the outdoor fan 19, and the like. The outdoor heat exchanger 16 has an L shape in plan view. The outdoor heat exchanger 16 is disposed along two adjacent side walls 61*a* and 61*b* of the casing 61 disposed in the heat exchange chamber S2. The side walls 61*a* and 61*b* are provided with air inlets 61*a*1 and 61*b*1, respectively. The outdoor fan 19 is disposed facing a side wall 61*c* adjacent to the side wall 61*b* provided with the air inlet 61*b*1. The side wall 61*c* is provided with an air blow-out port 61*c*1.

When the outdoor fan 19 operates, air is taken into the casing 61 from the air inlets 61*a*1 and 61*b*1 and discharged from the air blow-out port 61*c*1. An arrow a shown in FIG. 2 indicates a flow direction of the air taken into the casing 61.

Configuration of Refrigerant Pipe

As shown in FIG. 1, the refrigerant pipe 51 connected between the discharge side of the compressor 15 and the first port P1 of the four-way switching valve 18 includes a first refrigerant pipe 51*a* and a second refrigerant pipe 51*b*. Of these refrigerant pipes, the first refrigerant pipe 51*a* is a discharge pipe having one end directly connected to a discharge port of the compressor 15. One end of the second refrigerant pipe 51*b* is connected to the first port P1 of the four-way switching valve 18. The other end of the first refrigerant pipe 51*a* and the other end of the second refrigerant pipe 51*b* are connected via a refrigerant flow path module 40.

The refrigerant pipe 52 connected between a suction side of the compressor 15 and the third port P3 of the four-way switching valve 18 includes a third refrigerant pipe 52*a* and a fourth refrigerant pipe 52*b*. Of these refrigerant pipes, the third refrigerant pipe 52*a* is a suction pipe that has one end connected to a suction port of the compressor 15 (substantially, a suction port of the accumulator 15*b*; see FIG. 2). One end of the fourth refrigerant pipe 52*b* is connected to the third port P3 of the four-way switching valve 18. The other end of the third refrigerant pipe 52*a* and the other end of the fourth refrigerant pipe 52*b* are connected to each other via the refrigerant flow path module 40.

Figure 3:
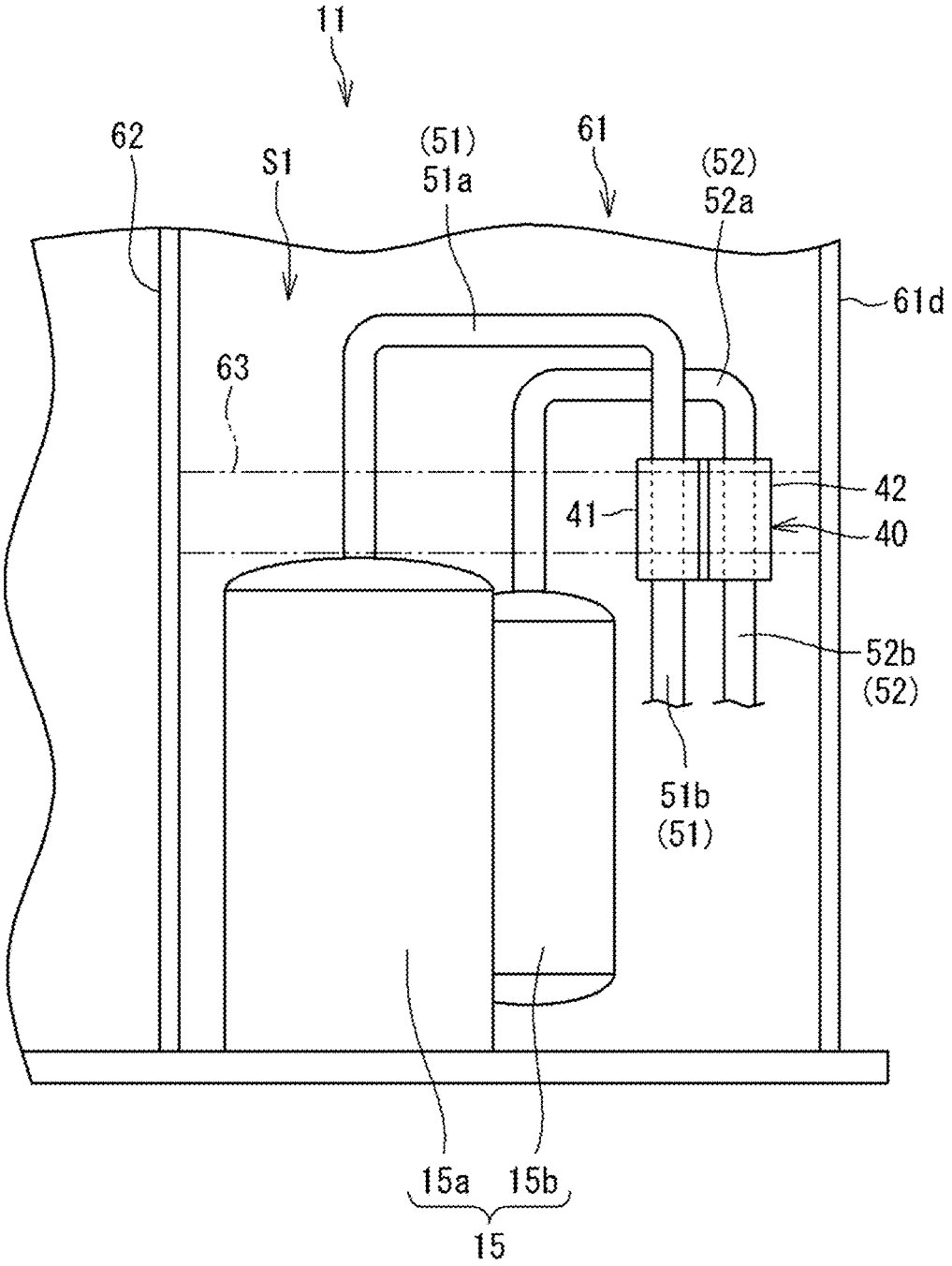
FIG. 3 is a front view of a machine chamber of the heat source unit.

FIG. 3 is a front view of the machine chamber of the heat source unit.

As shown in FIGS. 2 and 3, the refrigerant flow path module 40 is disposed in the machine chamber S1 in the casing 61 of the outdoor unit 11. The refrigerant flow path module 40 is fixed to an attachment member 63 attached to the casing 61. The attachment member 63 has a band plate shape, and has one longitudinal end fixed to a side wall 61*d* (side wall facing the side wall 61*b*) of the casing 61 and the other longitudinal end fixed to the partition wall 62. Therefore, the attachment member 63 is bridged between the side wall 61*d* and the partition wall 62 so as to cross the machine chamber S1. As shown in FIG. 2, the attachment member 63 is also used to attach the liquid-side shutoff valve 23 and the gas-side shutoff valve 24 to the casing 61.

Figure 4:
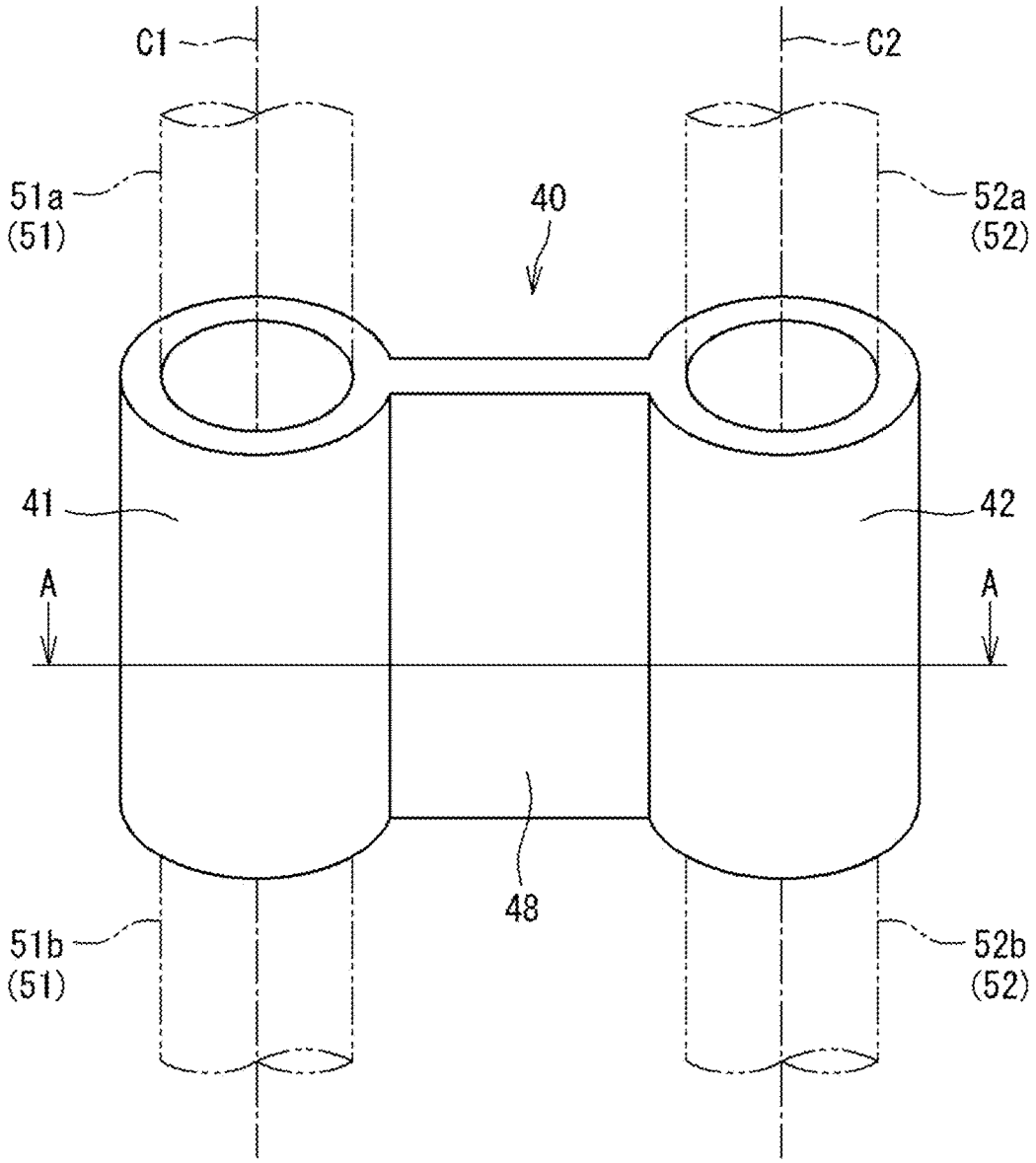
FIG. 4 is a schematic perspective view of a refrigerant flow path module.

FIG. 4 is a schematic perspective view of the refrigerant flow path module.

As shown in FIG. 4, the refrigerant flow path module 40 includes a first pipe portion 41, a second pipe portion 42, and a coupling portion 48. The first pipe portion 41 has a cylindrical shape. The first pipe portion 41 has a cylindrical flow path therein. A pipe axial center (center of the cylindrical shape) C1 of the first pipe portion 41 is linear and disposed so as to face upward and downward. An upper end and a lower end of the first pipe portion 41 are opened. The discharge pipe 51*a* through which a refrigerant from the compressor 15 flows is connected to the upper end opening of the first pipe portion 41. The second refrigerant pipe 51*b* connected to the first port P1 of the four-way switching valve 18 is connected to the lower end opening of the first pipe portion 41. The first pipe portion 41 and the second pipe portion 42 can be connected to the refrigerant pipes 51*a*, 51*b*, 52*a*, and 52*b* by brazing. However, the connection is not limited to brazing, and for example, insertion joints may be provided at ends of the first pipe portion 41 and the second pipe portion 42, and the refrigerant pipes 51*a*, 51*b*, 52*a*, and 52*b* may be connected by being inserted into the joints.

The second pipe portion 42 has a cylindrical shape. The second pipe portion 42 has a cylindrical flow path therein. A pipe axial center (the center of the cylindrical shape) of the second pipe portion 42 is linear and disposed so as to face upward and downward. An upper end and a lower end of the second pipe portion 42 are opened. The suction pipe 52*a* through which a refrigerant flows to the compressor 15 is connected to the upper end opening of the second pipe portion 42. The fourth refrigerant pipe 52*b* connected to the third port P3 of the four-way switching valve 18 is connected to the lower end opening of the second pipe portion 42.

The first pipe portion 41 and the second pipe portion 42 are disposed at intervals in a horizontal direction. The pipe axial center C1 of the first pipe portion 41 and a pipe axial center C2 of the second pipe portion 42 are parallel to each other. A length of the first pipe portion 41 in a direction of the pipe axial center is the same as a length of the second pipe portion 42 in a direction of the pipe axial center.

A coupling portion 48 couples the first pipe portion 41 and the second pipe portion 42. The coupling portion 48 has a plate shape. A plate surface of the coupling portion 48 is disposed along a direction parallel to the pipe axial centers C1 and C2 of the first and second pipe portions 41 and 42. A plate thickness of the coupling portion 48 is smaller than an outer diameter and an inner diameter of the first pipe portion 41 and the second pipe portion 42. The coupling portion 48 is provided over the entire lengths of the first pipe portion 41 and the second pipe portion 42 in the direction of the pipe axial centers.

The refrigerant flow path module 40 includes a material containing aluminum as a main component, for example, aluminum alloy or pure aluminum. The refrigerant flow path module 40 is formed by casting. Specifically, the refrigerant flow path module 40 is formed by die casting. The first pipe portion 41, the second pipe portion 42, and the coupling portion 48 of the refrigerant flow path module 40 are simultaneously molded by one mold. Therefore, the first pipe portion 41, the second pipe portion 42, and the coupling portion 48 are integrally formed. Here, "integrally formed" means that a plurality of elements are linked in a continuous form using the same material without a division plane. Therefore, a form in which a plurality of elements are mechanically linked with a screw or the like, or are linked without melting a base material, by brazing or the like, is excluded.

The first pipe portion 41 and the second pipe portion 42 are not required to include a material containing aluminum as a main component, but may include a material containing magnesium, zinc, or the like as a main component. The first pipe portion 41 and the second pipe portion 42 may include stainless steel or iron. The first pipe portion 41 and the second pipe portion 42 may be formed by cutting or the like instead of casting (die casting).

As shown in FIG. 3, the refrigerant flow path module 40 is connected to the discharge pipe 51*a* and the suction pipe 52*a* having one end connected to the compressor 15. Therefore, vibration generated by operation of the compressor 15 is transmitted to the refrigerant flow path module 40 via the discharge pipe 51*a* and the suction pipe 52*a*. Since the refrigerant flow path module 40 is fixed to the attachment member 63 attached to the casing 61, the transmitted vibration by blocked in the refrigerant flow path module 40, and hardly transmitted to the other refrigerant pipes 51*b* and 52*b* connected to the refrigerant flow path module 40.

In the refrigerant flow path module 40, the first pipe portion 41 and the second pipe portion 42 are integrally formed via the coupling portion 48. Therefore, in the refrigerant flow path module 40, a cross sectional area and a sectional secondary moment in a cross section in a direction orthogonal to pipe axial centers C1 and C2 (a cross section taken along line A-A in FIG. 4) are larger than those in a case where the first pipe portion 41 and the second pipe portion 42 are separated from each other. As a result, the refrigerant flow path module 40 has a high bending rigidity and is difficult to be deformed.

In the outdoor unit 11 including the compressor 15, a mode of vibration (vibration mode) representing what magnitude of vibration is transmitted from the compressor 15 is analyzed, and the lengths and the routes of the pipes connected to the compressor 15 are designed so as to suppress the transmission of the vibration. In one or more embodiments, since the refrigerant flow path module 40 is connected to ends of the discharge pipe 51*a* and the suction pipe 52*a* connected to the compressor 15, the discharge pipe 51*a* and the suction pipe 52*a* are coupled by the refrigerant flow path module 40 at a certain position in the direction of the pipe axial center. Therefore, the position of the refrigerant flow path module 40 hardly changes from a designed position at the time of assembling the outdoor unit 11 or the like. As a result, a mode of vibration assumed in design can be reproduced, and a vibration suppression effect can be obtained.

In addition, the first pipe portion 41, the second pipe portion 42, and the coupling portion 48 are integrally formed to enhance the bending rigidity of the refrigerant flow path module 40, and thus, deformation associated with the vibration of the compressor 15 is suppressed. Accordingly, a change in relative positions of the refrigerant pipes 51*a*, 51*b*, 52*a*, and 52*b* connected to the refrigerant flow path module 40 is also suppressed. As a result, analysis of vibration is facilitated, and design for suppressing vibration is also facilitated.

In one or more embodiments, since the first pipe portion 41 and the second pipe portion 42 are coupled by the coupling portion 48, the cross sectional area of the refrigerant flow path module 40 is further increased, and the bending rigidity (sectional secondary moment) is further enhanced.

Figure 5:
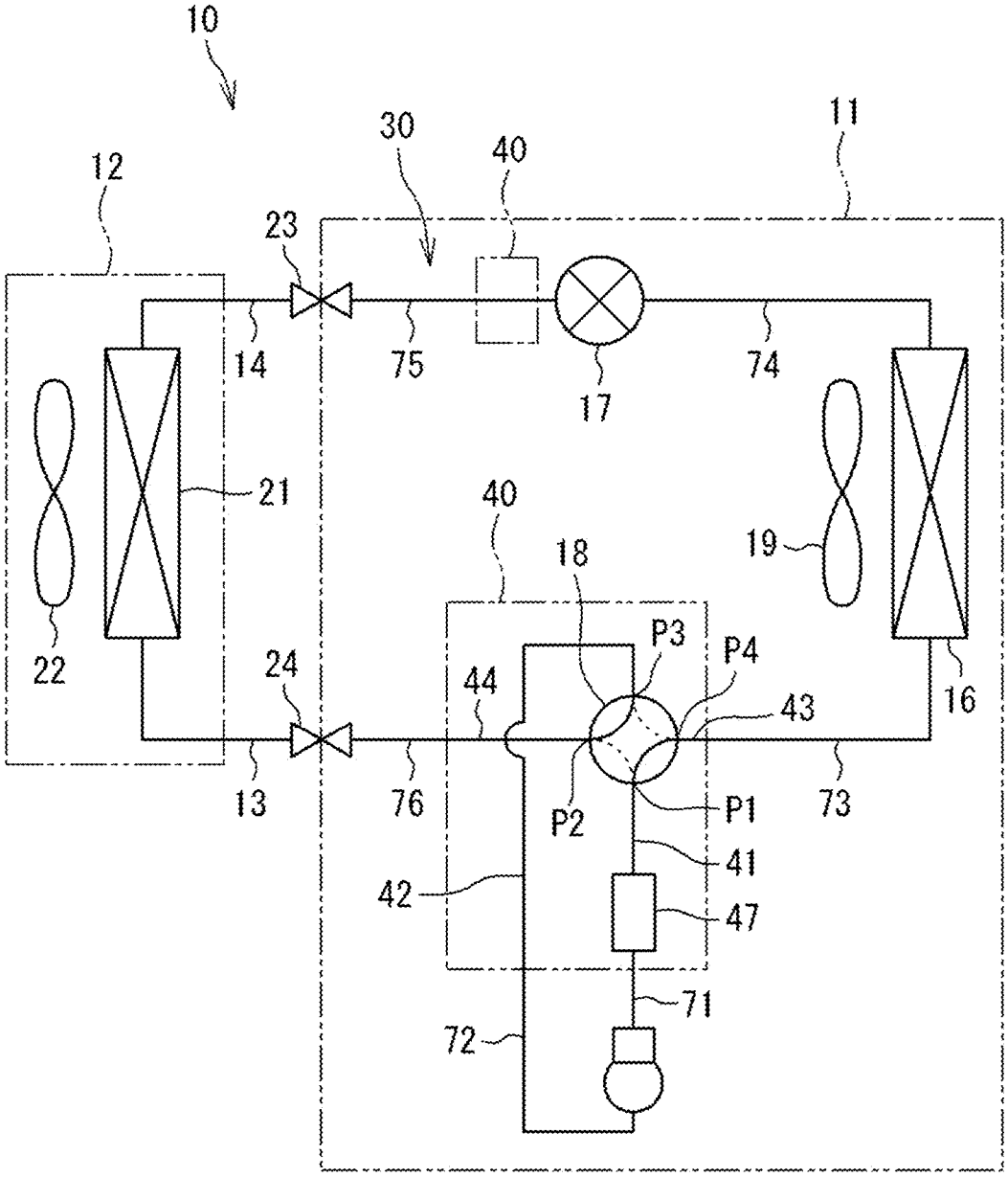
FIG. 5 is a schematic diagram of a refrigerant circuit of a refrigeration cycle apparatus including a heat source unit according to a second embodiment of the present disclosure.
Figure 6:
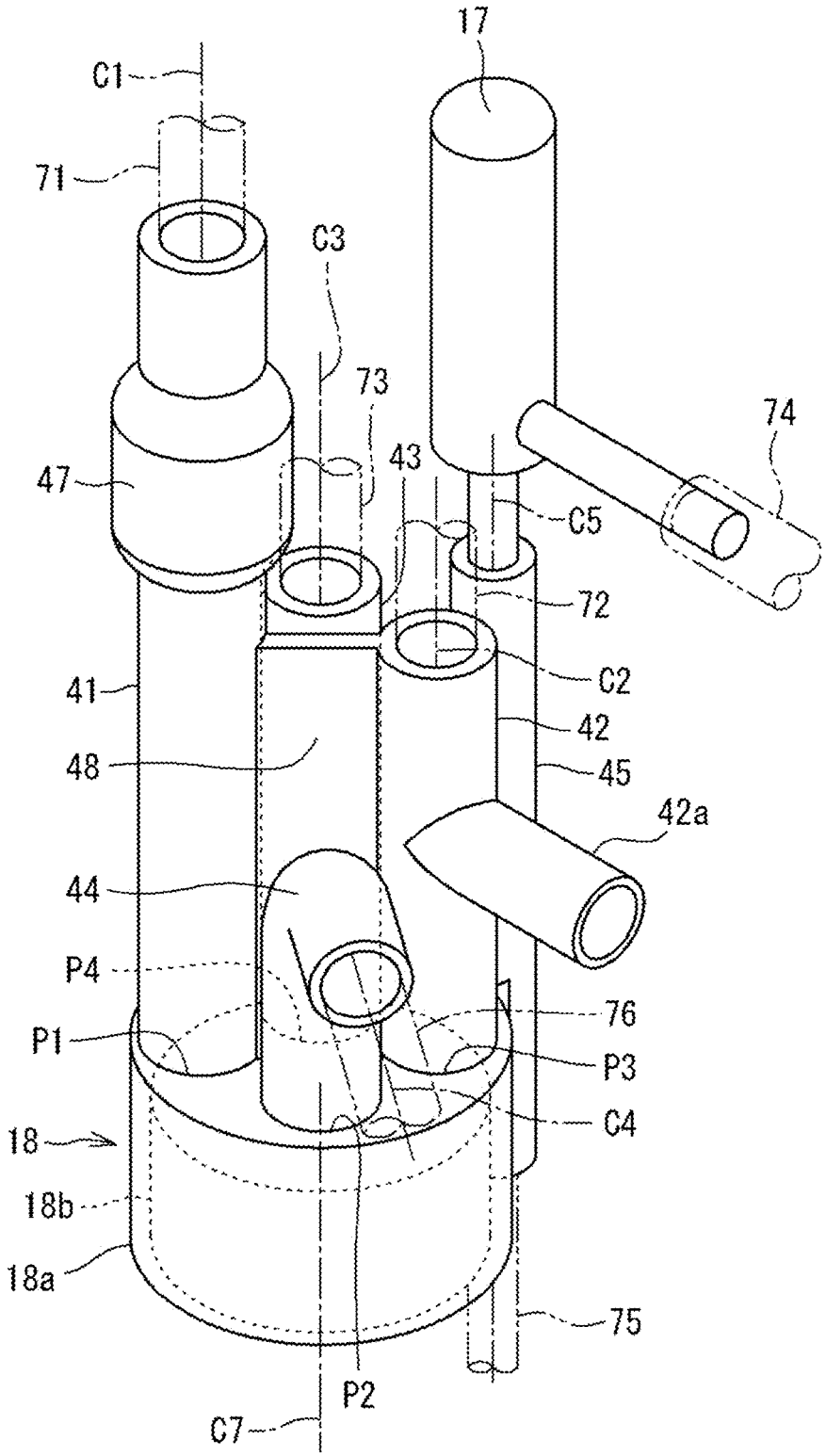
FIG. 6 is a schematic perspective view of a refrigerant flow path module.
Figure 7:
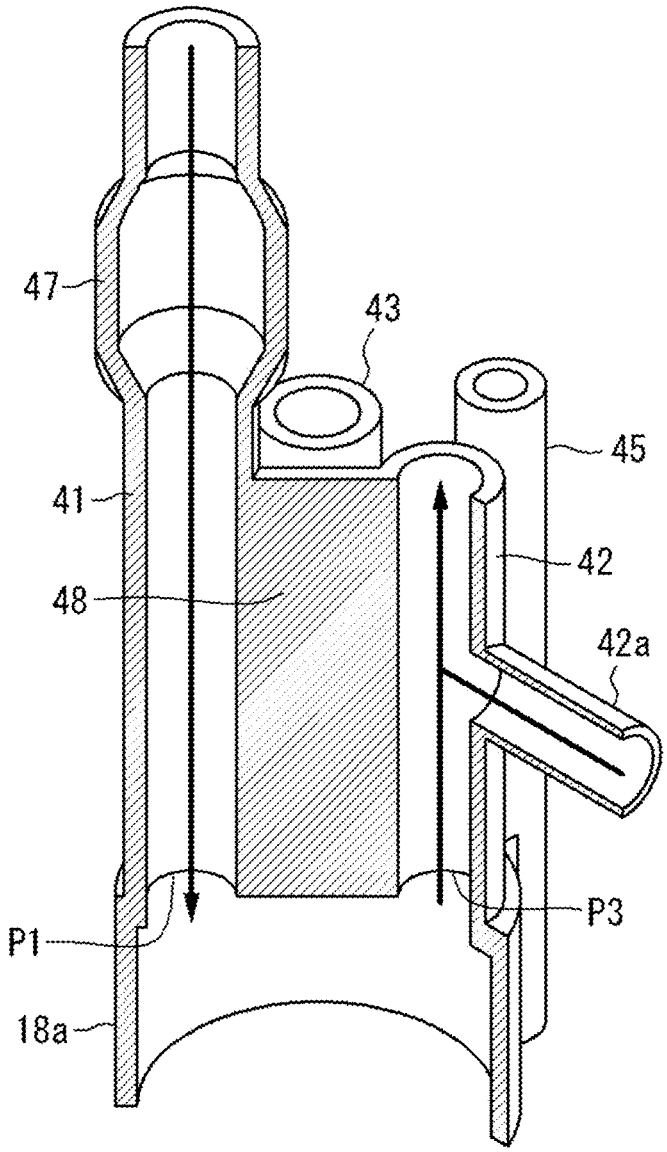
FIG. 7 is a schematic perspective view obtained by cutting a part of the refrigerant flow path module.

FIG. 5 is a schematic diagram of a refrigerant circuit of a refrigeration cycle apparatus including a heat source unit according to a second embodiment of the present disclosure. FIG. 6 is a schematic perspective view of a refrigerant flow path module. FIG. 7 is a schematic perspective view obtained by cutting a part of the refrigerant flow path module.

The refrigerant flow path module 40 according to one or more embodiments includes not only the first pipe portion 41 and the second pipe portion 42 but also third to fifth pipe portions 43 to 45. The refrigerant flow path module 40 according to one or more embodiments also includes a four-way switching valve 18.

The four-way switching valve 18 according to one or more embodiments is a rotary type. The four-way switching valve 18 includes a cylindrical case 18*a* and a cylindrical valve body 18*b* that rotates in the case 18*a*. The valve body 18*b* rotates about a center C7 of the cylindrical shape as an axis center. First to fourth ports P1 to P4 are provided on one end face of the case 18*a* in a direction of the axis center of the valve body 18*b*. A plurality of flow paths is formed in the valve body 18*b*. The flow paths selectively connect the first port P1 to one of the second port P2 or the fourth port P4 and selectively connect the third port P3 to one of the fourth port P4 or the second port P2 by the rotation of the valve body 18*b*. As the rotary type four-way switching valve 18, a conventionally known configuration can be adopted. In one or more embodiments, the axis center C7 of the valve body 18*b* is disposed along a vertical direction.

The first pipe portion 41 has a linear pipe axial center C1 as in the first embodiment. The pipe axial center C1 of the first pipe portion 41 is disposed in parallel with the axis center C7 of the valve body 18*b* of the four-way switching valve 18. One end of the first pipe portion 41 is connected to the first port P1 of the four-way switching valve 18. The other end of the first pipe portion 41 is connected to a discharge pipe 71 through which the refrigerant discharged from the compressor 15 flows. The first pipe portion 41 includes a muffler 47 in a midway in the direction of the pipe axial center. The muffler 47 suppresses noise due to pressure pulsation of the refrigerant discharged from the compressor 15.

The second pipe portion 42 has a linear pipe axial center C2 as in the first embodiment. The pipe axial center C2 of the second pipe portion 42 and the pipe axial center C1 of the first pipe portion 41 are disposed in parallel to each other. One end of the second pipe portion 42 is connected to the third port P3 of the four-way switching valve 18. The other end of the second pipe portion 42 is connected to a suction pipe 72 through which the refrigerant to be sucked into the compressor 15 flows.

The first pipe portion 41 and the second pipe portion 42 are coupled by a coupling portion 48. In one or more embodiments, the length of the second pipe portion 42 in the direction of the pipe axial center is shorter than the length of the first pipe portion 41 in the direction of the pipe axial center. The second pipe portion 42 has a branch 42*a* that branches in a direction orthogonal to a midway in the direction of the pipe axial center. The branch 42*a* is used to merge the refrigerant to be sucked into the compressor 15 from a part other than the third port P3 of the four-way switching valve 18. The branch 42*a* is closed by a lid or the like when not in use.

The third pipe portion 43 has a linear pipe axial center C3. The pipe axial center C3 of the third pipe portion 43 and pipe axial centers C1 and C2 of the first and second pipe portions 41 and 42 are disposed in parallel to each other. One end of the third pipe portion 43 is connected to the fourth port P4 of the four-way switching valve 18. The other end of the third pipe portion 43 is connected to a refrigerant pipe 73 connected to the gas-side end of the outdoor heat exchanger 16. In one or more embodiments, the length of the third pipe portion 43 in the direction of the pipe axial center is shorter than the length of the first pipe portion 41 in the direction of the pipe axial center, and is substantially the same as the length of the second pipe portion 42 in the direction of the pipe axial center.

The fourth pipe portion 44 has a pipe axial center C4 bent at about 90°. One end of the fourth pipe portion 44 is connected to the second port P2 of the four-way switching valve 18. The other end of the fourth pipe portion 44 is connected to the refrigerant pipe 76 connected to the gas-side shutoff valve 24. A part of the fourth pipe portion 44 connected to the second port P2 is disposed along the vertical direction, and a part of the fourth pipe portion 44 connected to the refrigerant pipe 76 is disposed along the horizontal direction.

The fifth pipe portion 45 has a linear pipe axial center C5. An end or an intermediate portion of the fifth pipe portion 45 in the direction of the pipe axial center is coupled to the case 18*a* of the four-way switching valve 18. One end of expansion valve 17 is directly connected to one end of the fifth pipe portion 45. The other end of the expansion valve 17 is connected to a refrigerant pipe 74 connected to the liquid-side end of the outdoor heat exchanger 16. The other end of the fifth pipe portion 45 is connected to a refrigerant pipe 75 connected to the liquid-side shutoff valve 23. Therefore, the fifth pipe portion 45 is not connected to the port of the four-way switching valve 18.

The first to fifth pipe portions 41 to 45 are integrally formed. The case 18*a* of the four-way switching valve 18 is formed integrally with the first to fifth pipe portions 41 to 45. Specifically, the first to fifth pipe portions 41 to 45 and the case 18*a* are molded by die casting or the like using a material containing aluminum as a main component.

In the first embodiment, the first pipe portion and the second pipe portion are integrally formed. However, in one or more embodiments, since the other members 43 to 45 and 18*a* are integrally formed in addition to the first pipe portion 41 and the second pipe portion 42, the bending rigidity of the refrigerant flow path module 40 is further enhanced, and deformation caused by vibration from the compressor 15 is suppressed.

In one or more embodiments, the first to fifth pipe portions 41 to 45, which are integrally formed, are collectively disposed at one place. Therefore, the refrigerant pipe 71 to 76 and the valve 17 connected to the refrigerant flow path module 40 can be compactly disposed, and can be efficiently laid out in a limited space (the machine chamber S1) in the outdoor unit 11.

In the refrigerant flow path module 40 according to one or more embodiments, the first to fourth pipe portions 41 to 44 extend from the four-way switching valve 18 in the same direction, specifically, upward. Therefore, the refrigerant pipes can be easily connected to the first to fourth pipe portions 41 to 44 from the same direction (upper side). In addition, since the first to fourth ports P1 to P4 are provided on an upper surface of the four-way switching valve 18, it is not necessary to connect a refrigerant pipe to a lower surface of the four-way switching valve 18. Therefore, the four-way switching valve 18 can be disposed at a low position, and a degree of freedom in installation of the four-way switching valve 18 in the machine chamber S1 can be increased. In one or more embodiments, the refrigerant flow path module 40 can be also fixed to the attachment member 63.

Figure 8:
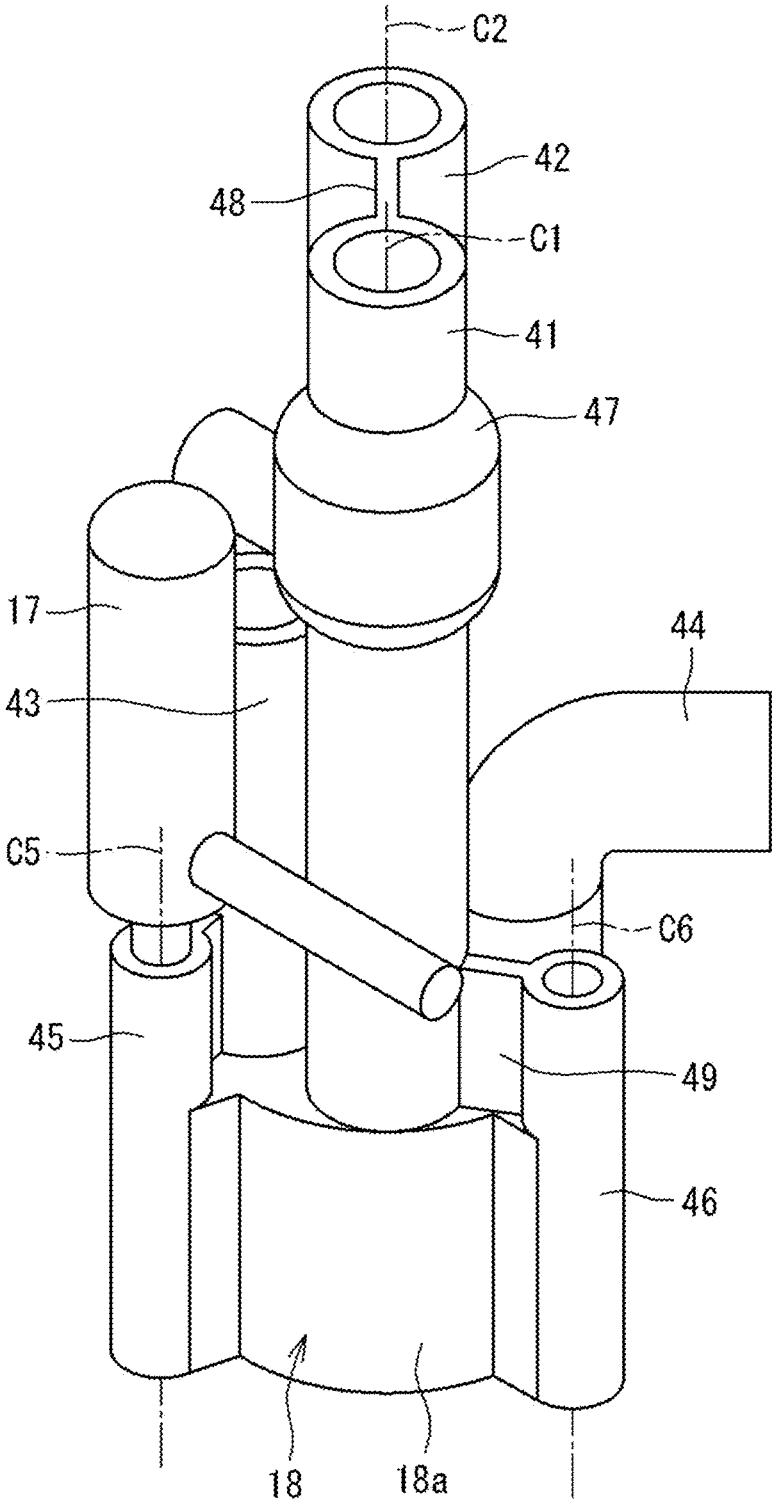
FIG. 8 is a perspective view for describing a use example of the refrigerant flow path module.
Figure 9:
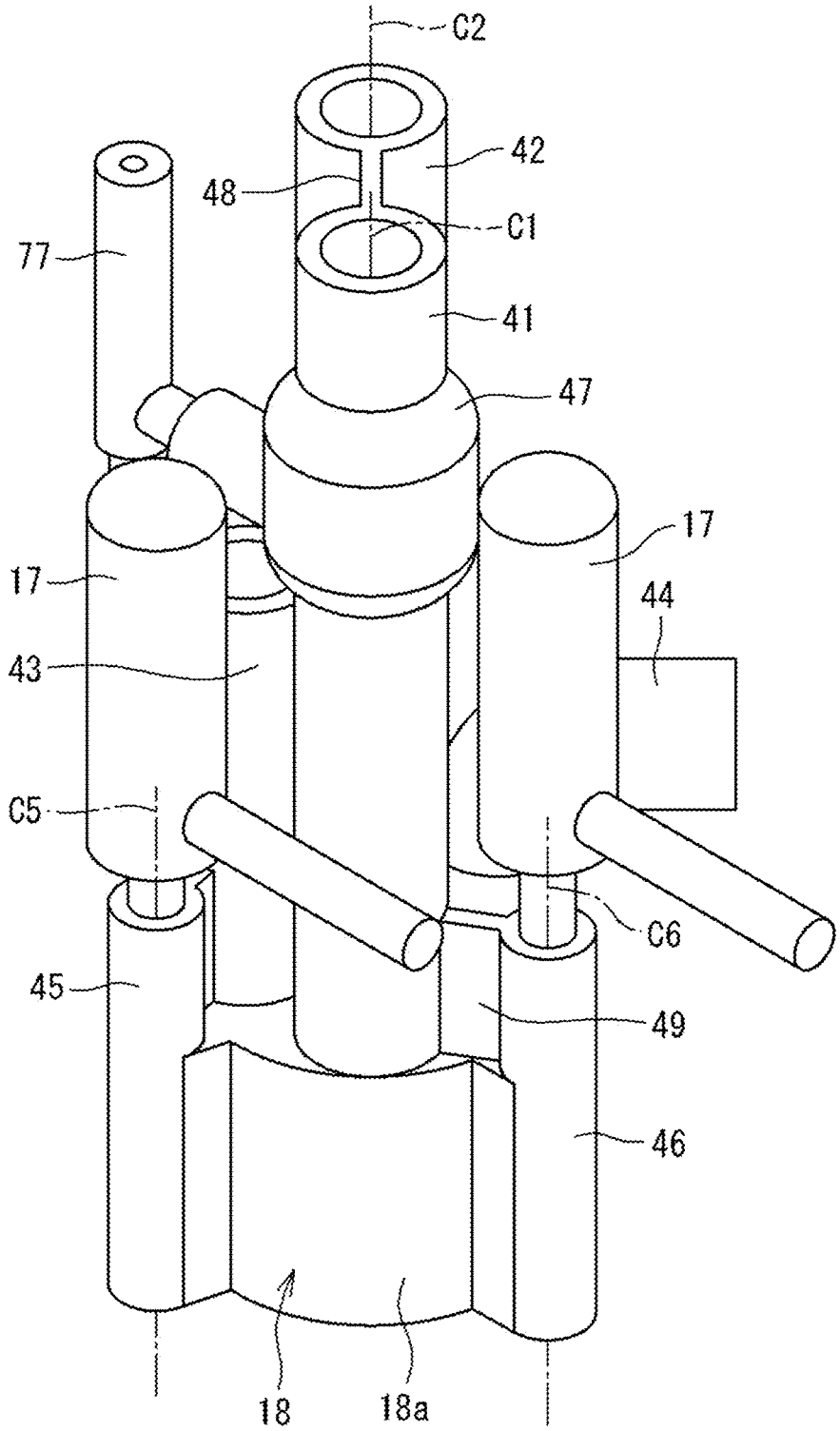
FIG. 9 is a perspective view for describing another use example of the refrigerant flow path module.

FIGS. 8 and 9 are perspective views for describing use examples of the refrigerant flow path module. FIGS. 8 and 9 show different use modes of the refrigerant flow path module 40 having the same shape. The refrigerant flow path module 40 includes the first to fifth pipe portions 41 to 45 as in the second embodiment, and also includes a sixth pipe portion 46. The sixth pipe portion 46 has substantially the same shape as the fifth pipe portion 45. The sixth pipe portion 46 is coupled to the case 18*a* of the four-way switching valve 18. The sixth pipe portion 46 is also coupled to the first pipe portion 41 via a plate-shaped coupling portion 49.

The outdoor unit 11 includes different numbers of valves and the like depending on specifications and the like. In the use example shown in FIG. 8, the expansion valve 17 is connected to the fifth pipe portion 45. Nothing is connected to the sixth pipe portion 46. In the use example shown in FIG. 9, the expansion valve 17 is provided in both the fifth pipe portion 45 and the sixth pipe portion 46. In the example shown in FIG. 9, an on-off valve 77 is attached to the branch 42*a* of the second pipe portion 42.

The same refrigerant flow path module 40 can be used for the outdoor units 11 having different specifications as described above, and a refrigerant pipe can be connected or a functional component such as a valve can be connected by using only a necessary pipe portion. It is therefore possible to achieve a reduction in costs by the use of common components.

Figure 10:
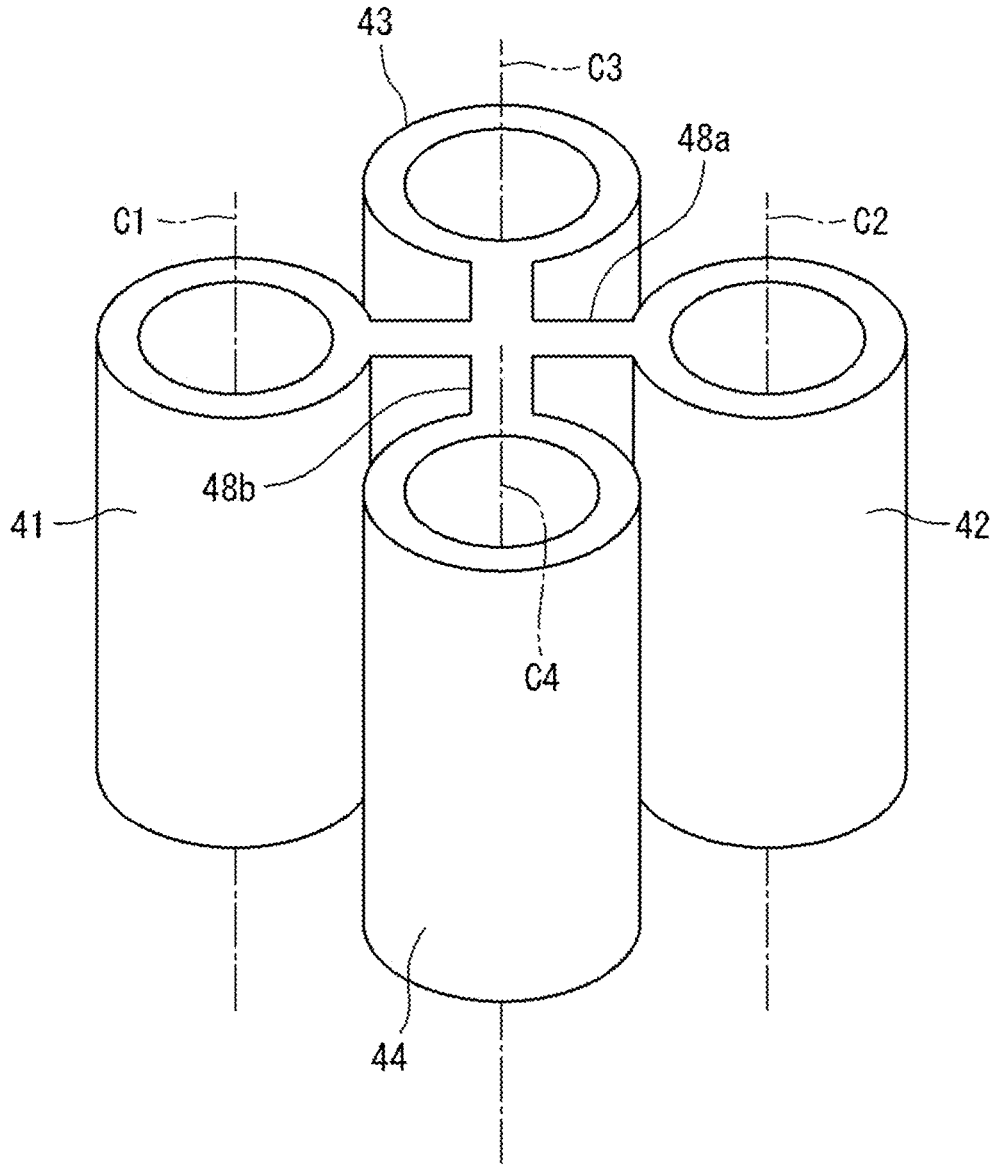
FIG. 10 is a schematic perspective view showing a modification of the refrigerant flow path module.
Figure 11:
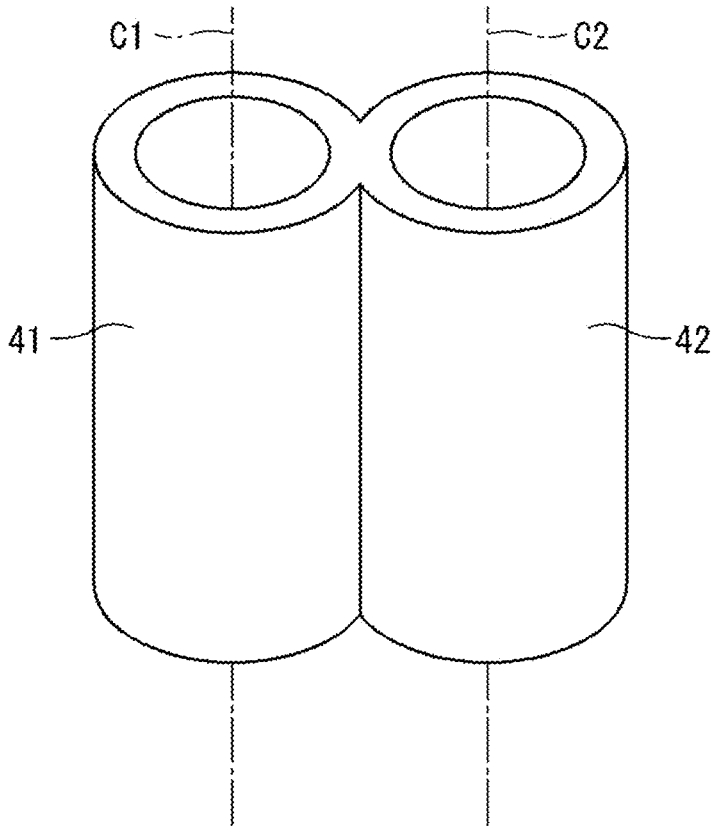
FIG. 11 is a schematic perspective view showing a modification of the refrigerant flow path module.
Figure 12:
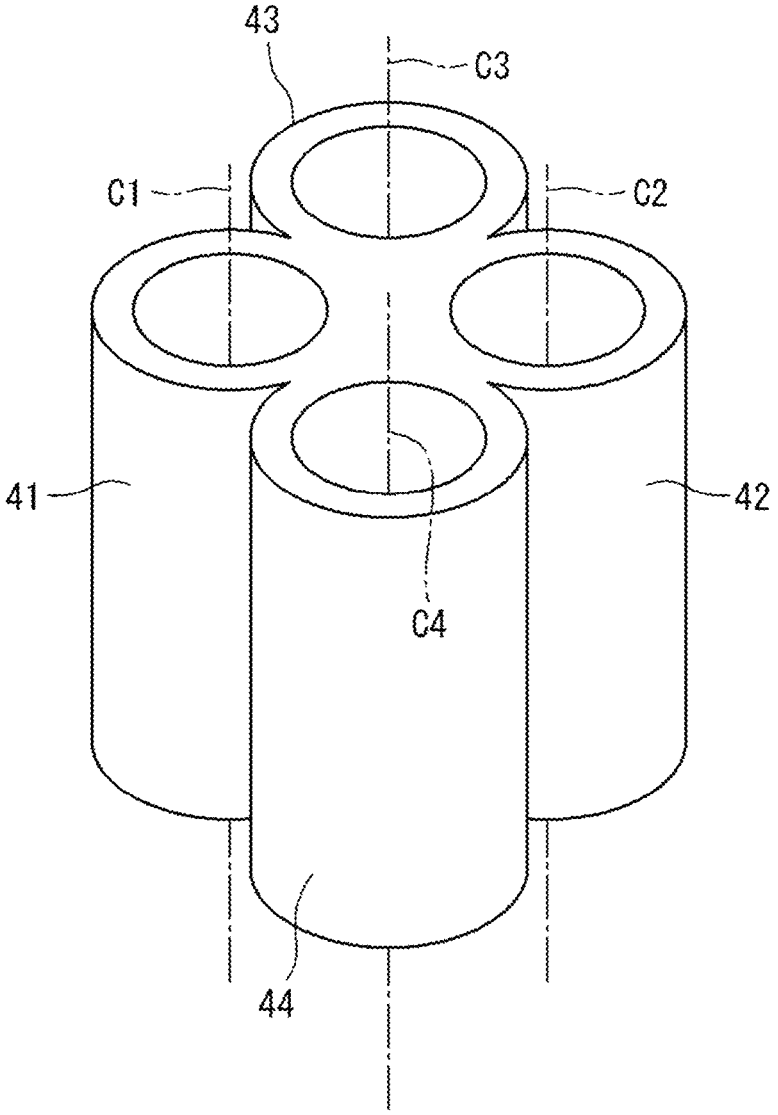
FIG. 12 is a schematic perspective view showing a modification of the refrigerant flow path module.

FIGS. 10 to 12 are schematic perspective views each showing a modification the refrigerant flow path module.

The refrigerant flow path module shown in FIG. 10 includes the first to fourth pipe portions 41 to 44 and does not include the four-way switching valve 18. The first to fourth pipe portions 41 to 44 are arranged in a quadrangular shape. The first to fourth pipe portions 41 to 44 are coupled by a first coupling portion 48*a* and a second coupling portion 48*b* arranged in an intersecting manner.

In one or more embodiments, the first to fourth pipe portions 41 to 44 have the same length in the direction of the pipe axial center. However, these pipe portions may have different lengths. The coupling portion may couple the pipe portions adjacent to each other.

In the refrigerant flow path module 40 shown in FIG. 11, the first pipe portion 41 and the second pipe portion 42 are directly and integrally formed without interposing a coupling portion therebetween. In the refrigerant flow path module 40 shown in FIG. 12, the first to fourth pipe portions 41 to 44 are directly and integrally formed without interposing a coupling portion therebetween. In any of the modifications, since the plurality of pipe portions are integrally formed, the cross sectional area and the sectional secondary moment in the direction orthogonal to the pipe axial center are increased, and the bending rigidity can be enhanced. Therefore, deformation due to vibration transmitted from the compressor 15 can be suppressed.

Other Embodiments

In the above embodiments, each pipe portion constituting the refrigerant flow path module 40 has a cylindrical shape. However, for example, an outer peripheral surface of each pipe portion may have a rectangular shape (block shape).

In the refrigerant flow path module 40 described in the second embodiment (FIG. 6), the four-way switching valve 18 is disposed on the lower side, and the first to fourth pipe portions 41 to 44 extend upward from the four-way switching valve 18. However, the present disclosure is not limited thereto, and the four-way switching valve 18 may be disposed on the upper side, and the first to fourth pipe portions 41 to 44 may extend downward from the four-way switching valve 18.

Action and Effects of Embodiments

In the technique described in PATENT LITERATURE 1, middle portions of the plurality of pipes in a longitudinal direction are simply coupled to each other by the fixture, and the work is considered to be performed by manual work. Therefore, there is a possibility that the position of the fixture with respect to the pipe, for example, the position of the fixture in the longitudinal direction of the pipe varies. If the position of the fixture deviates even a little from a designed position, there is a possibility that a mode of vibration (such as a direction or magnitude of vibration) changes unexpectedly, and a vibration suppression effect cannot be obtained.

The present disclosure provides a refrigerant flow path module and a heat source unit in which a discharge pipe and a suction pipe connected to a compressor can be coupled at an accurate position.

(1) The refrigerant flow path module 40 according to the above embodiments includes the first pipe portion 41 to which the discharge pipe 51*a*, 71 through which the refrigerant discharged from the compressor 15 of the refrigerant circuit 30 flows is connected, the first pipe portion 41 having a cylindrical flow path, and the second pipe portion 42 to which the suction pipe 52*a*, 72 through which the refrigerant to be sucked into the compressor 15 flows is connected, the second pipe portion 42 having a cylindrical flow path, in which the first pipe portion 41 and the second pipe portion 42 are integrally formed. In this way, the discharge pipe 51*a*, 71 and the suction pipe 52*a*, 72 are coupled to each other at a fixed position by connecting the discharge pipe 51*a*, 71 and the suction pipe 52*a*, 72 to the first pipe portion 41 and the second pipe portion 42, respectively, which are integrally formed. As a result, a mode of vibration assumed in design can be reproduced, and a vibration suppression effect can be obtained. Since the bending rigidity (sectional secondary moment) of the refrigerant flow path module 40 is increased by integrally forming the first pipe portion 41 and the second pipe portion 42, deformation of the refrigerant flow path module 40 in association with vibration is suppressed. Therefore, variation in a relative position between the discharge pipe 51*a*, 71 and the suction pipe 52*a*, 72 is suppressed, and analysis of the vibration and the like is facilitated, and it is possible to contribute to the suppression of the vibration.

(2) In the above embodiments, the refrigerant flow path module 40 further includes the coupling portion 48, 48*a* disposed between the first pipe portion 41 and the second pipe portion 42 and formed integrally with the first pipe portion 41 and the second pipe portion 42. In this way, since the first pipe portion 41 and the second pipe portion 42 are integrally formed with the coupling portion 48, 48*a* interposed therebetween, the bending rigidity of the refrigerant flow path module 40 can be further enhanced. Since an interval between the first pipe portion 41 and the second pipe portion 42 can be widened by the coupling portion 48, 48*a*, the degree of freedom in arrangement of the first pipe portion 41 and the second pipe portion 42 can be increased.

(3) In the above embodiments, the refrigerant circuit 30 further includes the first heat exchanger (outdoor heat exchanger) 16, the second heat exchanger (indoor heat exchanger) 21, and the flow path switching valve (four-way switching valve) 18 that switches the refrigerant flow path from the compressor 15 to the first heat exchanger 16 and the refrigerant flow path from the compressor 15 to the second heat exchanger 21. The refrigerant flow path module 40 further includes the third pipe portion 43 through which the refrigerant flows from the flow path switching valve 18 to the first heat exchanger 16, the third pipe portion 43 having a cylindrical flow path, and the fourth pipe portion 44 through which the refrigerant flows from flow path switching valve 18 to the second heat exchanger 21, the fourth pipe portion 44 having a cylindrical flow path. The first pipe portion 41, the second pipe portion 42, the third pipe portion 43, and the fourth pipe portion 44 are integrally formed. In this way, since the first to fourth pipe portions 41 to 44 are integrally formed, the bending rigidity of the refrigerant flow path module 40 can be further enhanced, and deformation due to vibration transmitted from the compressor 15 can be suppressed.

(4) The refrigerant flow path module 40 according to the above embodiments may further include the flow path switching valve 18, in which the flow path switching valve 18 includes a rotary valve body 18*b* that switches and connects the first pipe portion 41 to the third pipe portion 43 or the fourth pipe portion 44, and the first pipe portion 41, the second pipe portion 42, the third pipe portion 43, and the fourth pipe portion 44 extend from the flow path switching valve 18 in the same direction (for example, upward). In this way, another refrigerant pipe can be connected to the first to fourth pipe portions 41 to 44 from the same direction (direction opposite to the flow path switching valve 18), and assembling workability of the refrigerant circuit 30 can be improved.

(5) In the refrigerant flow path module 40 according to the above embodiments, at least two of the first pipe portion 41, the second pipe portion 42, the third pipe portion 43, or the fourth pipe portion 44 are integrally formed at a portion protruding from the flow path switching valve 18. For example, in the embodiment shown in FIG. 6, the first pipe portion 41 and the second pipe portion 42 are coupled via the coupling portion 48 at a portion protruding upward from the flow path switching valve 18. This configuration can enhance the bending rigidity of the pipe portions in the portion protruding from the flow path switching valve 18. The present disclosure is not limited to the embodiment shown in FIG. 6. The first pipe portion 41 and the third pipe portion 43 and/or the fourth pipe portion 44 may be integrally formed at a portion protruding from the flow path switching valve 18, the second pipe portion 42 and the third pipe portion 43 and/or the fourth pipe portion 44 may be integrally formed at a portion protruding from the flow path switching valve 18, and the third pipe portion 43 and the fourth pipe portion 44 may be integrally formed at a portion protruding from the flow path switching valve 18.

(6) The refrigerant flow path module 40 according to the above embodiments includes a material containing aluminum as a main component. It is therefore possible to easily manufacture the refrigerant flow path module in which the first pipe portion 41 and the second pipe portion 42 or the first to fourth pipe portions 41 to 44 are integrally formed by using a manufacturing method such as aluminum die casting having a high degree of freedom of a moldable shape.

(7) The heat source unit (outdoor unit) 11 according to the above embodiments further includes the casing 61 that accommodates the compressor 15 and the refrigerant flow path module 40, in which the refrigerant flow path module 40 is fixed to the casing 61 or the member 63 attached to the casing 61. In this way, vibration transmitted from the compressor 15 through the discharge pipe 51*a*, 71 and the suction pipe 52*a*, 72 can be blocked by the refrigerant flow path module 40, and transmission of vibration to another refrigerant pipe connected to the refrigerant flow path module 40 can be suppressed.

(8) In the heat source unit 11 according to the above embodiments, the member 63 attached to the casing 61 is also used as an attachment member that attaches, to the casing 61, the shutoff valve 23, 24 that connects, of refrigerant pipes constituting the refrigerant circuit 30, the refrigerant pipe (connection pipe) 13, 14 disposed outside the heat source unit 11 and the refrigerant pipe 55, 56, 75, 76 disposed inside the heat source unit 11. Therefore, the pipe portions 41 to 44 and the flow path switching valve 18 can be fixed by effectively utilizing the attachment member 63 that is fixed to the casing 61 and attaches the shutoff valve 23, 24.

(9) The heat source unit 11 according to the above embodiments includes the compressor 15 and the refrigerant flow path module 40, in which the first pipe portion 41, the second pipe portion 42, the third pipe portion 43, and the fourth pipe portion 44 extend upward from the flow path switching valve 18. Therefore, when the heat source unit 11 is assembled, another refrigerant pipe can be easily connected from the upper side of the first to fourth pipe portions 41 to 44.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

11 outdoor unit (heat source unit)
15 compressor
16 outdoor heat exchanger (first heat exchanger)
17 expansion valve
18 four-way switching valve (flow path switching valve)
21 indoor heat exchanger (second heat exchanger)
23 liquid-side shutoff valve
24 gas-side shutoff valve
30 refrigerant circuit
40 refrigerant flow path module
41 first pipe portion
42 second pipe portion
43 third pipe portion

44 fourth pipe portion
45 fifth pipe portion
48 coupling portion
48*a* first coupling portion
48*b* second coupling portion
51*a* discharge pipe
52*a* suction pipe
61 casing
63 attachment member
71 discharge pipe
72 suction pipe

What is claimed is:

1. A refrigerant flow path module comprising:
a first pipe portion having a cylindrical flow path and connected to a discharge pipe through which a refrigerant discharged from a compressor of a refrigerant circuit flows; and
a second pipe portion having a cylindrical flow path and connected to a suction pipe through which a refrigerant to be sucked into the compressor flows, wherein
the refrigerant circuit comprises:
a first heat exchanger;
a second heat exchanger; and
a flow path switching valve that switches a refrigerant flow path from the compressor to the first heat exchanger and a refrigerant flow path from the compressor to the second heat exchanger,
the first pipe portion and the second pipe portion are integrally formed separately from the flow path switching valve,
a first end of the first pipe portion is connected to an end of the discharge pipe,
a second end of the first pipe portion is connected to the flow path switching valve,
a first end of the second pipe portion is connected to an end of the suction pipe, and
a second end of the second pipe portion is connected to the flow path switching valve.

2. The refrigerant flow path module according to claim 1, further comprising a coupling portion disposed between the first pipe portion and the second pipe portion and formed integrally with the first pipe portion and the second pipe portion.

3. The refrigerant flow path module according to claim 1, wherein
the refrigerant flow path module further comprises:
a third pipe portion having a cylindrical flow path and through which a refrigerant flows from the flow path switching valve to the first heat exchanger, and
a fourth pipe portion having a cylindrical flow path and through which a refrigerant flows from the flow path switching valve to the second heat exchanger,
the first pipe portion, the second pipe portion, the third pipe portion, and the fourth pipe portion are integrally formed,
an end of the third pipe portion is connected to an end of a refrigerant pipe through which a refrigerant flows from the flow path switching valve to the first heat exchanger, and
an end of the fourth pipe portion is connected to an end of a refrigerant pipe through which a refrigerant flows from the flow path switching valve to the second heat exchanger.

4. The refrigerant flow path module according to claim 3, further comprising:
the flow path switching valve, wherein
the flow path switching valve comprises a rotary valve body that switches and that connects the first pipe portion to either the third pipe portion or the fourth pipe portion, and
the first pipe portion, the second pipe portion, the third pipe portion, and the fourth pipe portion extend in a same direction from the flow path switching valve.

5. The refrigerant flow path module according to claim 1, comprising a material containing aluminum as a main component.

6. A heat source unit comprising:
the refrigerant flow path module according to claim 1; and
the compressor.

7. The heat source unit according to claim 6, further comprising:
a casing that accommodates the compressor and the refrigerant flow path module, wherein
the refrigerant flow path module is fixed to either the casing or a member attached to the casing.

8. The heat source unit according to claim 7, wherein
the refrigerant flow path module is fixed to an attachment member attached to the casing, and
the attachment member attaches a shutoff valve to the casing, wherein the shutoff valve connects a refrigerant pipe disposed outside the heat source unit to a refrigerant pipe disposed inside the heat source unit among refrigerant pipes constituting the refrigerant circuit.

9. A heat source unit comprising:
the refrigerant flow path module according to claim 4; and
the compressor, wherein
the first pipe portion, the second pipe portion, the third pipe portion, and the fourth pipe portion of the refrigerant flow path module extend upward from the flow path switching valve.

10. The refrigerant flow path module according to claim 1, wherein the refrigerant flow path module is fixed to either a casing that accommodates the compressor and the refrigerant flow path module or a member attached to the casing.

11. The refrigerant flow path module according to claim 1, further comprising
a coupling portion that couples the first pipe portion and the second pipe portion between the first pipe portion and the second pipe portion, wherein
the coupling portion extends over an entire length of the first pipe portion in a longitudinal direction of the first pipe portion, and
the coupling portion extends over an entire length of the second pipe portion in a longitudinal direction of the second pipe portion.

12. A refrigerant flow path module comprising:
a first pipe portion having a cylindrical flow path and connected to a discharge pipe through which a refrigerant discharged from a compressor of a refrigerant circuit flows,
wherein
the refrigerant circuit comprises:
the compressor;
a first heat exchanger;
a second heat exchanger; and
a flow path switching valve that switches a refrigerant flow path from the compressor to the first heat exchanger and a refrigerant flow path from the compressor to the second heat exchanger;
a second pipe portion having a cylindrical flow path and connected to a suction pipe through which a refrigerant to be sucked into the compressor flows;

a third pipe portion having a cylindrical flow path, connected to the flow path switching valve, and through which a refrigerant flows from the flow path switching valve to the first heat exchanger;

a fourth pipe portion having a cylindrical flow path, connected to the flow path switching valve, and through which a refrigerant flows from the flow path switching valve to the second heat exchanger; and the flow path switching valve of the refrigerant circuit, wherein the flow path switching valve comprises a rotary valve body that switches and that connects the first pipe portion to either the third pipe portion or the fourth pipe portion, the first pipe portion, the second pipe portion, the third pipe portion, and the fourth pipe portion extend in a same direction from the flow path switching valve, and at least two of the first pipe portion, the second pipe portion, the third pipe portion, and the fourth pipe portion are integrally formed at portions of the at least two of the first pipe portion, the second pipe portion, the third pipe portion, and the fourth pipe portion protruding from the flow path switching valve.

13. The refrigerant flow path module according to claim 12, further comprising a coupling portion, wherein the coupling portion integrally couples the at least two of the first pipe portion, the second pipe portion, the third pipe portion, and the fourth pipe portion over an entire length of at least one of the at least two of the first pipe portion, the second pipe portion, the third pipe portion, and the fourth pipe portion.

* * * * *